US006619997B1

(12) United States Patent
Wilson et al.

(10) Patent No.: US 6,619,997 B1
(45) Date of Patent: Sep. 16, 2003

(54) MODULAR CONNECTOR STRAIN RELIEF BACK SHELL AND WIRING METHOD

(75) Inventors: George A. Wilson, Belle Vernon, PA (US); Ronald J. Schmidt, North Huntingdon, PA (US)

(73) Assignee: Bombardier Transportation (DE)

( * ) Notice: Subject to any disclaimer, the term of this patent is extended or adjusted under 35 U.S.C. 154(b) by 0 days.

(21) Appl. No.: 10/174,495

(22) Filed: Jun. 18, 2002

Related U.S. Application Data

(60) Provisional application No. 60/299,020, filed on Jun. 18, 2001.

(51) Int. Cl.[7] ..... H01R 13/502

(52) U.S. Cl. ..... 439/701; 439/457; 439/719; 439/464; 439/471; 439/371; 439/540.1

(58) Field of Search ..... 439/701, 686, 439/695, 719, 464, 471, 371, 457, 540.1

(56) References Cited

U.S. PATENT DOCUMENTS

| | | | | | |
|---|---|---|---|---|---|
| 3,087,984 | A | * | 4/1963 | Waranch | 174/135 |
| 3,778,748 | A | * | 12/1973 | Holman | 439/251 |
| 3,794,960 | A | * | 2/1974 | Sugar | 439/459 |
| 3,874,765 | A | * | 4/1975 | Gilmore et al. | 439/464 |
| 4,414,426 | A | * | 11/1983 | Burtelson | 174/59 |
| 4,417,781 | A | * | 11/1983 | Johnston et al. | 439/718 |
| 4,550,960 | A | | 11/1985 | Asick et al. | 339/14 R |
| 4,832,614 | A | | 5/1989 | Jenkins | 439/188 |
| 4,846,706 | A | * | 7/1989 | Lee | 439/104 |
| 4,918,886 | A | * | 4/1990 | Benoit et al. | 174/48 |
| 5,035,645 | A | * | 7/1991 | Siemon et al. | 439/532 |
| 5,198,618 | A | | 3/1993 | Shieh | 174/67 |
| 5,281,161 | A | * | 1/1994 | Kanai | 439/357 |
| 5,326,284 | A | | 7/1994 | Bohbot et al. | 439/676 |
| 5,639,267 | A | * | 6/1997 | Loudermilk | 439/701 |
| 5,683,257 | A | | 11/1997 | Kobayashi et al. | 439/76.2 |
| 5,732,747 | A | * | 3/1998 | Holliday | 138/163 |
| 5,997,361 | A | | 12/1999 | Driscoll et al. | 439/701 |
| 6,123,564 | A | | 9/2000 | Belmore, III | 439/344 |

* cited by examiner

*Primary Examiner*—Tho D. Ta
(74) *Attorney, Agent, or Firm*—Webb Ziesenhiem Logsdon Orkin & Hanson, P.C.

(57) ABSTRACT

A modular electrical connector back shell apparatus that provides wire strain relief when using pre-wired modules for electrical wiring applications. The apparatus includes a housing, a modular frame insertable into the housing, and a plurality of modular connectors insertable into the modular frame. The housing includes a plurality of wire-tie receiving orifices for fastening the wires in the pre-wired modular connectors to the housing via a wire-tie inserted through at least two wire-tie receiving orifices and fastened around at least one wire.

20 Claims, 4 Drawing Sheets

MODULAR CONNECTOR STRAIN RELIEF BACK SHELL AND WIRING METHOD

CROSS REFERENCE TO RELATED APPLICATIONS

This application claims the benefit of U.S. Provisional Application Ser. No. 60/299,020 filed Jun. 18, 2001 which is incorporated by reference in its entirety.

BACKGROUND OF THE INVENTION

1. Field of the Invention

This invention relates to an electrical connector assembly and, more particularly, to a modular electrical connector back shell apparatus having a wire strain relief.

2. Description of the Prior Art

Electrical circuits for many applications including, for example, vehicle electrical wiring applications, are becoming increasingly faster and more complex with the need to accommodate many electrical circuits and components on printed circuit boards or back panels. It is frequently necessary in complex systems to inner-connect circuits contained on back panels to circuits in other locations, for example, by using multi-wiring electrical cabling. As electronic circuits increasingly become faster in operation and more complex, their sensitivity to radio frequency interference and other electrical magnetic radiation increases. Consequently, electrical cables connecting electronic circuits from other locations to back panels or circuit boards are frequently isolated from this interference by casing the cables in a conductive shield or shell.

One form of electrical connectors available for affecting contact between multi-wire cables and electrical circuits contained on printed circuit boards or back panels, is to use a modular electrical connector system. These modular systems allow the assembly of pre-wired modules to be connected to the proper pins on a back panel. These modular connectors also permit the quick connection of multi-wires in a cable to circuits on a printed circuit board or back panel.

Often times with complex circuitry, high-density contacts between cables and printed circuit boards make it difficult to make inner-connections between multi-wired cables and these printed circuit boards. Many times, the wire in the module has to be stretched or strained in order to make contact with the pins on a circuit board or back panel. Sometimes these wires are strained at a 90° angle or greater. Over time this may cause the wire cable insulation to rip or tear apart and expose the live wire. Any exposure of live wire presents a safety hazard and may result in a short circuit. Additionally, when the wire is strained, the wire may disconnect from the back panel or circuit board.

Therefore, it is an object of the present invention to overcome these deficiencies by providing a modular connector strain relief back shell apparatus that provides wire strain relief.

SUMMARY OF THE INVENTION

The present invention is a modular connector strain relief back shell apparatus which may be used in connection with vehicle wiring systems. The modular connector strain relief back shell apparatus includes three sections, a first section, a second section, and a third section. The first section includes a housing having a first open side and a second open side. A plurality of wire-tie receiving orifices are defined adjacent the second open side of the housing. The second section includes a modular frame having a plurality of receiving sections. The modular frame is capable of being received within the housing. The third section includes at least one modular connector having a plurality of wire-receiving cavities for receiving wire. Each modular connector is capable of being received within the receiving section of the modular frame.

The housing includes a first wall, a second wall, a third wall, and a fourth wall. The walls have an inner surface and define a rectangular-shaped cavity. The plurality of wire-tie receiving orifices is defined on the first wall and the second wall of the housing. The housing also includes a plurality of protruding orifices for receiving fasteners. At least one protruding orifice is defined on the inner surface adjacent the third wall of the housing, and at least one protruding orifice is defined on the inner surface adjacent the fourth wall of the housing. Further, the housing includes a plurality of latch pins extending away from the cavity. At least one latch pin is defined on the first wall and at least one latch pin is defined on the second wall of the housing.

The modular frame includes a first open end, a second open end, a first frame wall, a second frame wall, a third frame wall , and a fourth frame wall. The frame walls have an inner surface and an outer surface. The inner surface of the frame walls define an interior cavity, and the third frame wall and the fourth frame wall define the plurality of receiving sections of the modular frame. Further, each receiving section of the modular frame includes a pair of tab-receiving slots, a pair of clip-receiving grooves, and a pair of longitudinal extending protrusions for guiding and securing the modular connector within the receiving section of the modular frame. The pair of tab-receiving slots further includes a first tab-receiving slot defined on the third frame wall adjacent the first open side of the modular frame and a second tab-receiving slot defined on the fourth frame wall adjacent the first open side of the modular frame. The pair of clip-receiving grooves further includes a first clip-receiving groove defined on the outer surface of the third frame wall and a second clip-receiving groove defined on the outer surface of the fourth frame wall. The pair of protrusions further includes a first protrusion defined on the inner surface of the third frame wall and a second protrusion defined on the inner surface of the fourth frame wall.

The modular frame also includes a first lip and a second lip. The first lip is defined on the first frame wall adjacent the second open end of the modular frame and extends radially outward away from the interior cavity. The second lip is defined on the second frame wall adjacent the second open end and extends radially outward away from the interior cavity. Further, the first lip and the second lip of the modular frame include a plurality of slots adapted to receive fasteners for securing the modular frame to the housing via the orifices in the housing.

The modular connector includes a body having a first side, a second side, a third side, and a fourth side. The plurality of wire-receiving cavities is defined on the body and extends from the first side to the second side of the body. The body further includes a pair of guide slits, a pair of clips, and a pair of tabs.

The pair of guide slits includes a first guide slit defined on the third side of the body and a second guide slit defined on the fourth side of the body. The guide slits are adapted to engage the protrusions in the receiving section of the modular frame. The pair of clips includes a first clip and a second clip. The first clip is defined on the third side of the body and extends axially in a direction toward the second side of the body. The second clip is defined on the fourth side of the body and extends axially in a direction toward the second side of the body. The clips are adapted to fasten into the clip-receiving grooves in the receiving section of the modular frame. The pair of tabs includes a first tab and a second tab. The first tab is defined on the third side of the body and extends axially in a direction toward the second side of the body. The second tab is defined on the fourth side of the body and extends axially in a direction toward the second side of the body. The tabs are adapted to be received by the tab-receiving slots in the receiving section of the modular frame.

The present invention is also a method of providing wire strain relief when using pre-wired modules for electrical wiring applications. The method includes the steps of providing a modular connector strain relief back shell apparatus as previously described. Secondly, a plurality of wires is inserted through the wire-receiving cavities of the modular connector. Thirdly, the modular connector is inserted into the modular frame. Fourthly, the modular frame is inserted into the housing. Finally, at least one wire within the wire-receiving cavity is fastened to the housing via a wire-tie inserted through at least two wire-tie receiving orifices and fastened around the wire.

The attachment of the wire to the housing provides wire strain relief to the wires in order to keep the wires from either disconnecting from the terminals and/or tearing the insulation on the wires thereby exposing the live wire.

BRIEF DESCRIPTION OF THE DRAWINGS

The above objects and other advantages of the invention will be appreciated at the study of the detailed description of the preferred embodiments when read in conjunction with the drawings in which.

DETAILED DESCRIPTION OF THE PREFERRED EMBODIMENT

Figure 1:
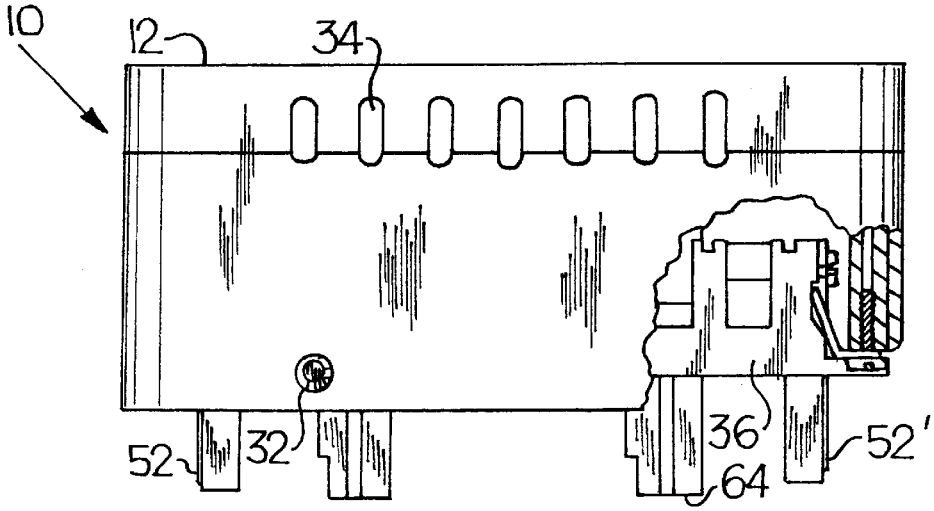
FIG. 1 is an elevational view of a modular connector strain relief back shell apparatus made in accordance with the present invention.

FIG. 1 shows a modular connector strain relief back shell apparatus 10 made in accordance with the present invention that includes a first section, a second section and a third section. The first section defines a housing 12, the second section defines a modular frame 36, and the third section defines a modular connector 64. The modular connector 64 is capable of being received with the modular frame 36 and the modular frame 36 is capable of being received within the housing 12.

Figure 2:
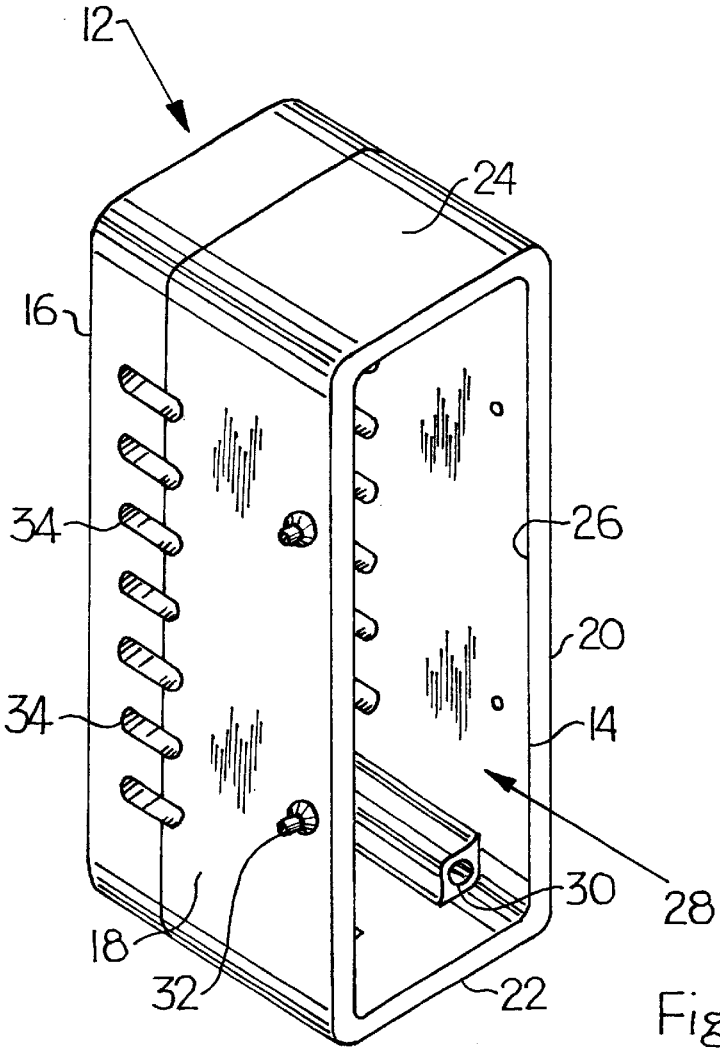
FIG. 2 is a perspective view of the housing of FIG. 1.
Figure 3:
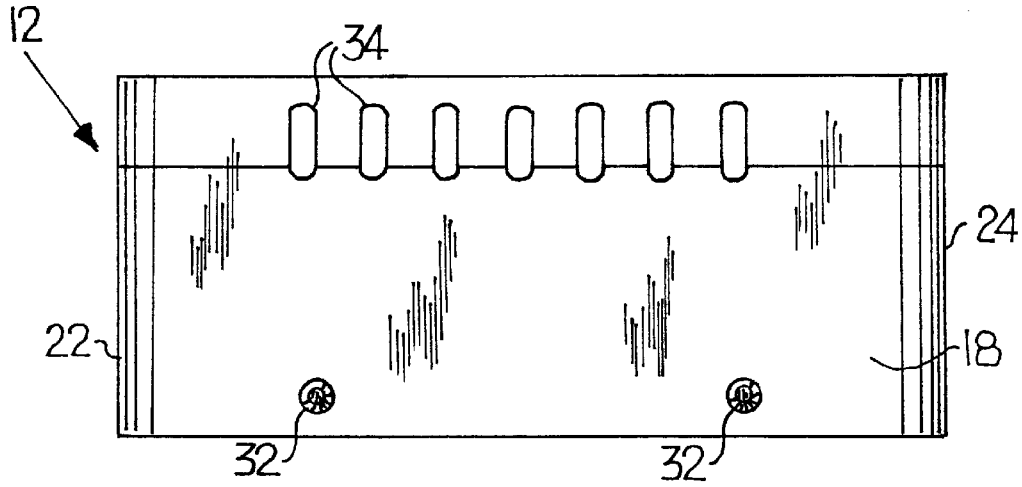
FIG. 3 is an elevational view of the housing of FIG. 2.
Figure 4:
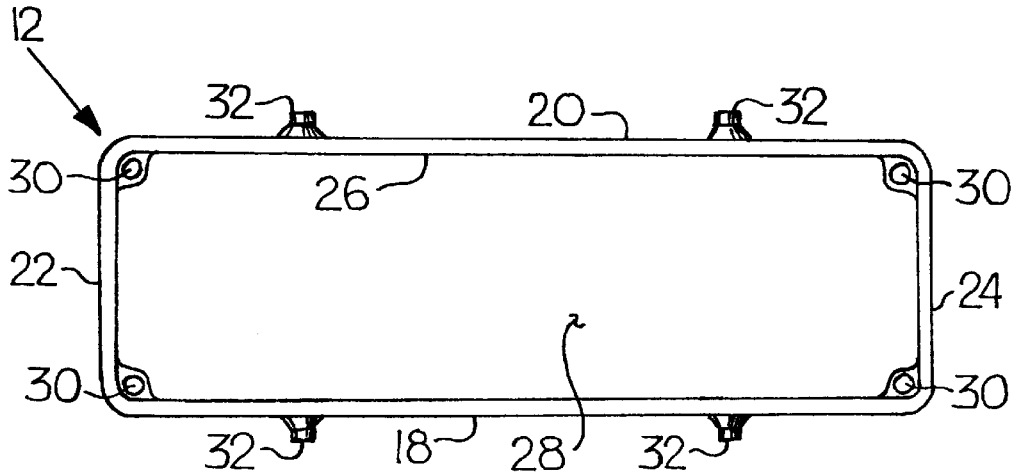
FIG. 4 is a plan view of the housing of FIG. 2.

Referring to FIGS. 2, 3, and 4, the housing 12 of the apparatus 10 is rectangular-shaped and has a first open side 14 and a second open side 16. The housing 12 includes a first wall 18, a second wall 20, a third wall 22, and a fourth wall 24 defining a rectangular-shaped cavity 28. An inner surface 26, defined by walls 18, 20, 22, and 24, which defines the cavity 28, includes a pair of internally threaded protruding orifices 30 positioned adjacent the third wall 22 and the fourth wall 24 of the housing 12. The first wall 18 and the second wall 20 of the housing 12 defines a plurality of wire-tie receiving orifices 34 positioned adjacent to the second open side 16 of the housing 12. Also, the first wall 18 and the second wall 20 of the housing 12 has at least one latch pin 32 extending away from the cavity 28 and positioned adjacent the first open side 14 of the housing 12. The housing 12 is preferably made of aluminum.

Figure 5:
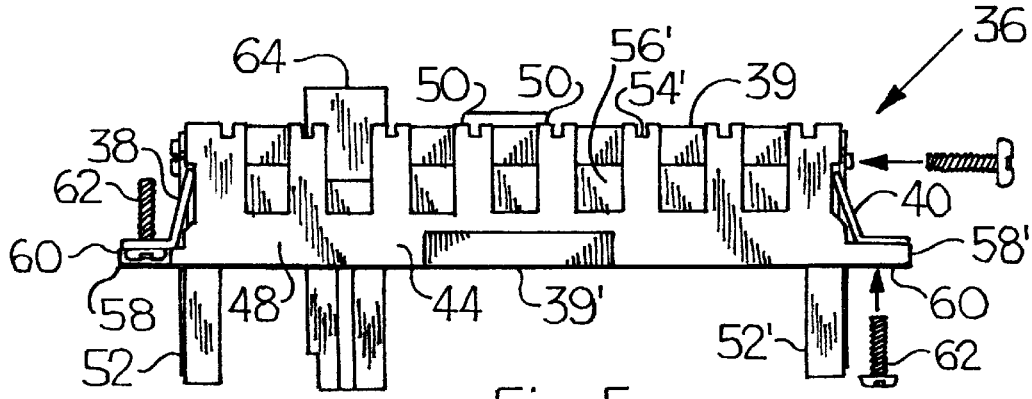
FIG. 5 is an elevational view of the modular frame of FIG. 1 having a modular connector inserted into the modular frame.
Figure 7:
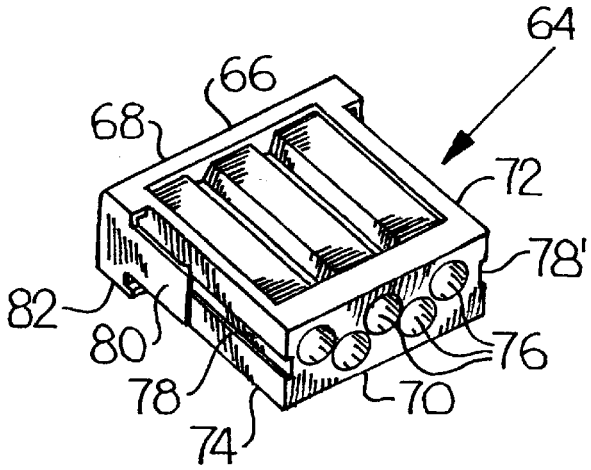
FIG. 7 is a perspective view of the modular connector of FIG. 1.
Figure 6:
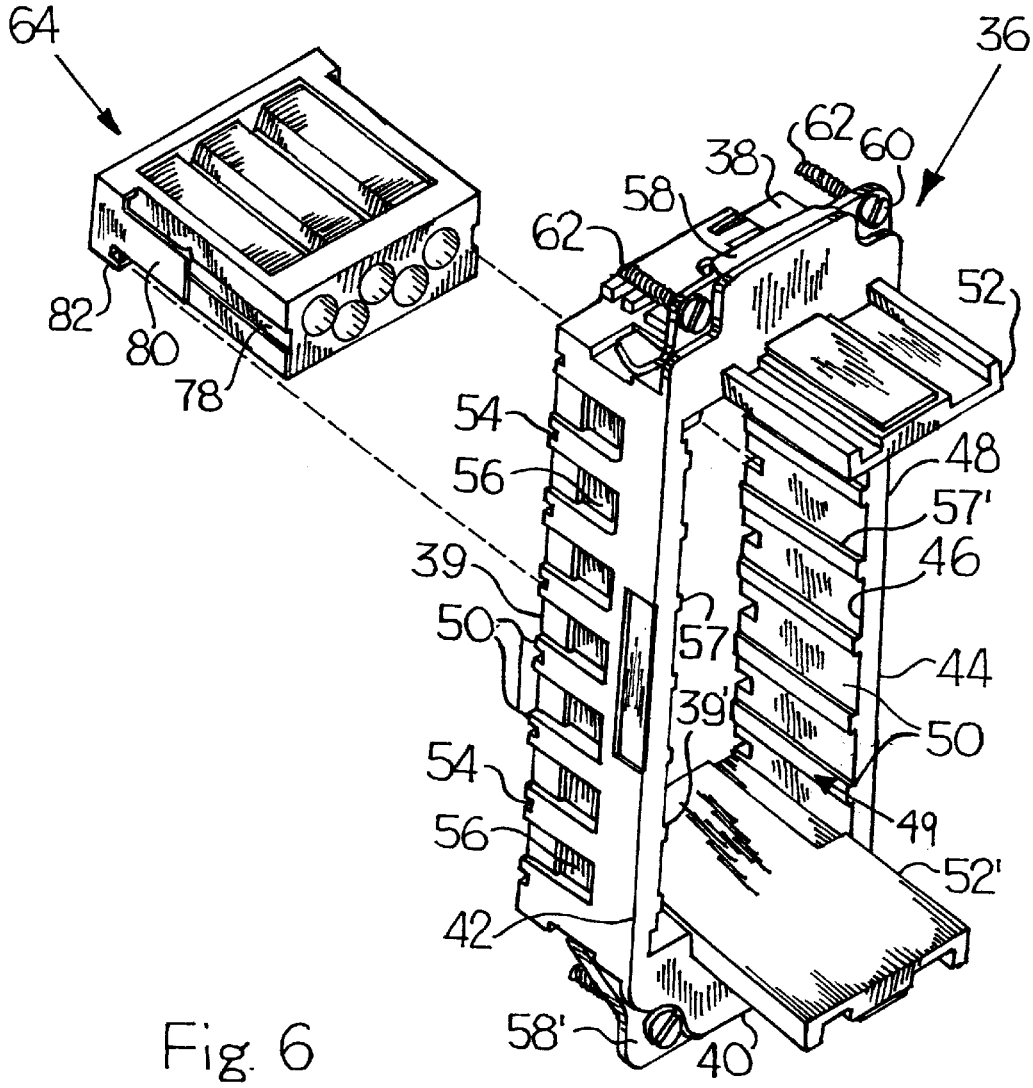
FIG. 6 is a perspective view of the modular frame of FIG. 5 showing the modular frame configured to receive the modular connector.
Figure 8:
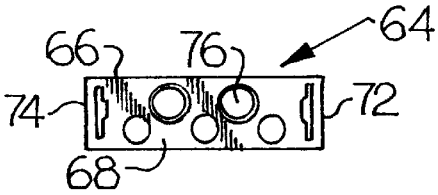
FIG. 8 is a front view of the modular connector of FIG. 7.
Figure 9:
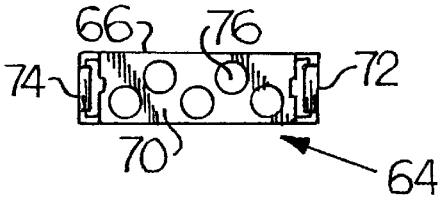
FIG. 9 is a back view of the modular connector of FIG. 7.
Figure 10:
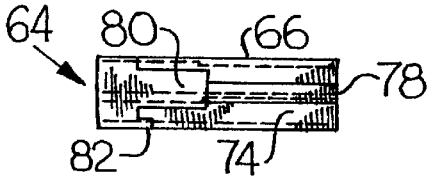
FIG. 10 is a side elevational view of the modular connector of FIG. 7.
Figure 11:
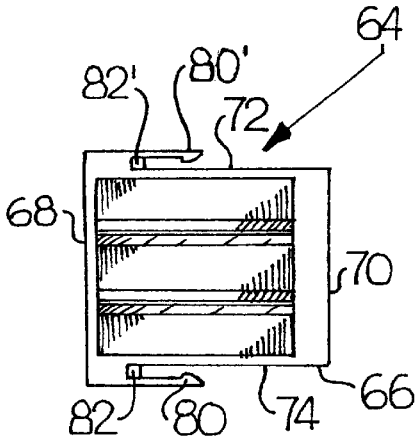
FIG. 11 is a plan view of the modular connector of FIG. 7.

Referring to FIGS. 5 and 6, the modular frame 36 is rectangular-shaped and includes a first open end 39, a second open end 39', a first frame wall 38, a second frame wall 40, a third frame wall 42, and a fourth frame wall 44. An inner surface 46 and an outer surface 48 are defined by frame walls 38, 40, 42, and 44, wherein the inner surface 46 of walls 38, 40, 42, and 44 define an interior cavity 49. The modular frame 36 also has a plurality of receiving sections 50 for receiving the modular connector 64. The interior cavity 49, the third frame wall 42, and the fourth frame wall 44 define the plurality of receiving sections 50 of the modular frame 36. The inner surface 46 of the first frame wall 38 and the second frame wall 40 of the modular frame 36 includes a set of rectangular shaped extensions 52, 52', extending axially outward from the modular frame 36. The extensions 52, 52' are used as supports when inserting the modular frame 36 into the cavity 28 of the housing 12. The modular frame 36 can be made of an electrical insulating material such as plastic.

Referring to FIG. 6, each of the receiving sections 50 of the modular frame 36 includes tab-receiving slots 54, 54', a pair of clip-receiving grooves 56, 56', and a pair of longitudinally extending protrusions 57, 57' for guiding and securing the modular connector 64 within the receiving section 50 of the modular frame 36. The tab-receiving slot 54 is defined on the third frame wall 42 adjacent the first open side 39 of the modular frame 36 and tab-receiving slot 54' is defined on the fourth frame wall 44 adjacent the first open side 39 of the modular frame 36. The clip-receiving groove 56 is defined on the outer surface 48 of the third frame wall 42 and clip-receiving groove 56' (shown in FIG. 5) is defined on the outer surface 48 of the fourth frame wall 44 of the modular frame 36. The protrusion 57 is defined on the inner surface 46 of the third frame wall 42 and protrusion 57' is defined on the inner surface 46 of the fourth frame wall 44 of the modular frame 36.

With reference to FIGS. 5 and 6, the first frame wall 38 and the second frame wall 40 of the modular frame 36 include a pair of lips 58, 58'. The lip 58 defined on the first frame wall 38 adjacent the second open end 39' of the modular frame 36 extends radially outward away from the interior cavity 49 of the modular frame 36. The lip 58' defined on the second frame wall 40 adjacent the second open end 39' of the modular frame 36', also extends radially outward away from the interior cavity 49 of the modular frame 36. Lips 58, 58' include a plurality of slots 60 for receiving threaded fasteners 62. Threaded fasteners 62 extend through each slot 60 on lips 58, 58', and are capable of fastening into the protruding orifices 30 in the cavity 28 of the housing 12.

FIGS. 7, 8, 9, 10, and 11 show the modular connector 64 having a rectangular-shaped body 66. The body 66 having a first side 68, a second side 70, a third side 72, and a fourth side 74 can be made of the same electrically insulating material as the modular frame 36. A plurality of wire-receiving cavities 76 are defined on the body 66 and extend from the first side 68 to the second side 70 of the body 66 of the modular connector 64. The body 66 also includes a pair of guide slits 78, 78', a pair of clips 80, 80', and a pair of tabs 82, 82'. Guide slits 78, 78' are defined on the third side 72 and the fourth side 74 of the body 66, respectively. The guide slits 78, 78' are used to guide the modular connector 64 into one of the receiving sections 50 of the modular frame 36 by slidably engaging each of the respective protrusions 57, 57' in the receiving section 50 of the modular frame 36 (shown in FIGS. 5 and 6). Clips 80, 80' are also defined of the third side 72 and the fourth side 74 of the body 66, respectively, and axially extend in a direction toward the second side 70 of the body 66. The clips 80, 80' of the modular connector 64 fastens into each of the respective clip-receiving grooves 56, 56' in the receiving section 50 whenever the modular connector 64 is inserted into the modular frame 36. Tabs 82, 82' are defined adjacent clips 80, 80' respectively, and axially extend in a direction toward the second side 70 of the body 66. The tabs 82, 82' of the modular connector 64 fit into each of the respective tab-receiving slots 54, 54' in the receiving section 50 of the modular frame 36.

Figure 12:
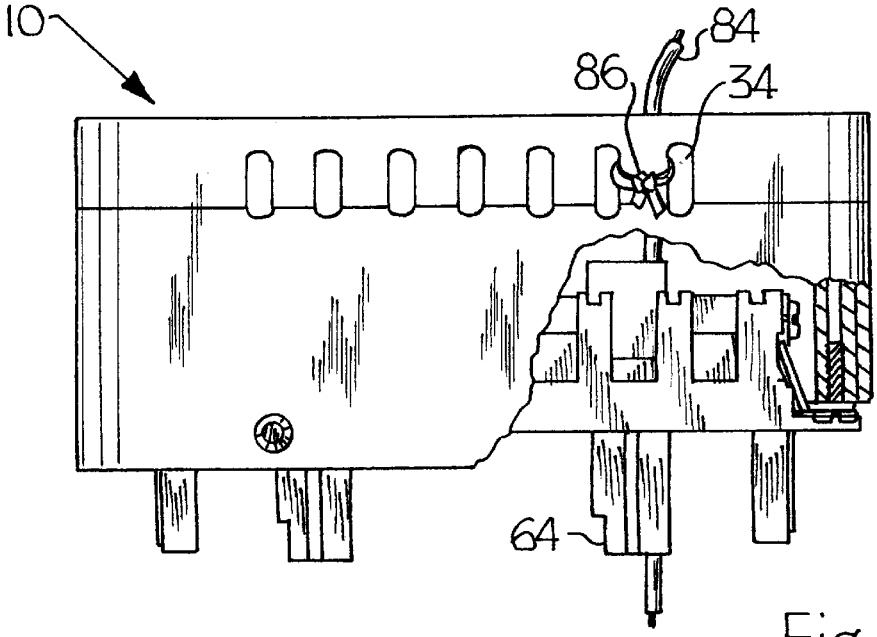
FIG. 12 shows the apparatus of FIG. 1 having a cable wire fastened to the housing by a wire-tie passing through two adjacent wire-tie receiving orifices.
Figure 13:
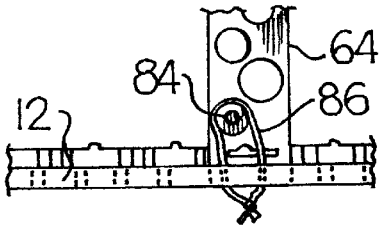
FIG. 13 is a plan sectional view of FIG. 12 showing the wire-tie wrapped around the cable wire and tied off at each end.

FIGS. 12 and 13 show the apparatus 10 having a cable wire 84 fastened to the housing 12 by a wire-tie 86 passing through two adjacent wire-tie receiving orifices 34.

In use, a plurality of cable wires 84 are placed through the wire-receiving cavities 76 of the modular connector 64. The modular connector 64 is inserted into one of the receiving sections 50 of the modular frame 36. The modular connector 64 is securely fastened into the receiving section 50 of the modular frame 36 when the clips 80, 80' engage the respective clip-receiving grooves 56, 56' of the modular frame 36. Similarly, a plurality of cable wires 84 can be placed through the wire-receiving cavities 76 of a plurality of modular connectors 64. The plurality of modular connectors 64 can then be inserted into each of the receiving sections 50 of the modular frames 36. The modular frame 36 is then fastened into the housing 12 via the threaded fastener 62. One or more of the cable wires 84 in each of the modular connectors 64 can be fastened to the housing 12 by a wire-tie 86 inserted through the wire-tie receiving orifices 34 of the housing 12 as shown in FIG. 12. FIG. 13 shows the wire-tie 86 wrapped around the cable wire 84. Preferably, each wire-tie 86 passes through adjacent wire-tie receiving orifices 34 and is fastened together at each end. FIGS. 12 and 13 show the wire-tie 86 tied together by twisting each end over one another. The wire-tie 86 can also be a cable tie where each end of the cable tie is fastened together by a fastener. Fastening the cable wire 84 to the housing 12 provides wire strain relief to the cable wires 84 in order to keep the wires 84 from either disconnecting from the terminals and/or tearing the insulation on the wires 84 thereby exposing the live wire.

Although the present invention has been described in detail in connection with the discussed embodiments, various modifications may be made by one of ordinary skill in the art without deporting from the spirit and scope of the present invention.

What is claimed:

1. A modular connector strain relief back shell apparatus comprising:

a housing having a first open side and a second open side;

a plurality of wire-tie receiving orifices defined adjacent said second open side of said housing;

a modular frame having a plurality of receiving sections, said modular frame capable of being received within said housing; and at least one modular connector having a plurality of wire-receiving cavities for receiving wire, wherein said modular connector capable of being received within said receiving section of said modular frame.

2. The apparatus as claimed in claim 1, wherein said housing comprises a first wall, a second wall, a third wall, and a fourth wall, said walls having an inner surface and defining a rectangular-shaped cavity.

3. The apparatus as claimed in claim 2, wherein said housing comprises a plurality of protruding orifices for receiving fasteners, at least one protruding orifice is defined on said inner surface adjacent said third wall of said housing, and at least one protruding orifice is defined on said inner surface adjacent said fourth wall of said housing.

4. The apparatus as claimed in claim 2, wherein said plurality of wire-tie receiving orifices are defined on said first wall and said second wall of said housing.

5. The apparatus as claimed in claim 2, wherein said housing comprises a plurality of latch pins extending away from said cavity, wherein at least one latch pin is defined on said first wall and at least one latch pin is defined on said second wall of said housing.

6. The apparatus as claimed in claim 1, wherein said modular frame comprises:

a first open end, a second open end, a first frame wall, a second frame wall, a third frame wall, and a fourth frame wall, said frame walls having an inner surface and an outer surface, wherein said inner surface of said frame walls define an interior cavity.

7. The apparatus as claimed in claim 6, wherein said interior cavity, said third frame wall, and said fourth frame wall define said plurality of receiving sections of said modular frame.

8. The apparatus as claimed in claim 7, wherein each receiving section of said modular frame comprises a pair of tab-receiving slots, a pair of clip-receiving grooves, and a pair of longitudinal extending protrusions for guiding and securing said modular connector within said receiving section of said modular frame.

9. The apparatus as claimed in claim 8, wherein said pair of tab-receiving slots further comprises a first tab-receiving slot defined on said third frame wall adjacent said first open side of said modular frame and a second tab-receiving slot defined on said fourth frame wall adjacent said first open side of said modular frame.

10. The apparatus as claimed in claim 8, wherein said pair of clip-receiving grooves further comprises a first clip-receiving groove defined on said outer surface of said third frame wall and a second clip-receiving groove defined on said outer surface of said fourth frame wall.

11. The apparatus as claimed in claim 8, wherein said pair of protrusions further comprises a first protrusion defined on said inner surface of said third frame wall and a second protrusion defined on said inner surface of said fourth frame wall.

12. The apparatus as claimed in claim 6, wherein said modular frame comprises a first lip and a second lip, said first lip is defined on said first frame wall adjacent said second open end of said modular frame and extends radially outward away from said interior cavity, and said second lip is defined on said second frame wall adjacent said second open end and extends radially outward away from said interior cavity.

13. The apparatus as claimed in claim 12, wherein said first lip and said second lip of said modular frame comprise a plurality of slots adapted to receive fasteners for securing said modular frame to said housing via said orifices in said housing.

14. The apparatus as claimed in claim 8, wherein said modular connector comprises a body having a first side, a second side, a third side, and a fourth side, and wherein said plurality of wire-receiving cavities is defined on said body and extends from said first side to said second side of said body.

15. The apparatus as claimed in claim 14, wherein said body comprises:

a pair of guide slits adapted to engage said protrusions in said receiving section of said modular frame;

a pair of clips adapted to fasten into said clip-receiving grooves in said receiving section of said modular frame; and a pair of tabs adapted to be received by said tab-receiving slots in said receiving section of said modular frame.

16. The apparatus as claimed in claim 15, wherein said pair of guide slits comprises a first guide slit defined on said third side of said body and a second guide slit defined on said fourth side of said body.

17. The apparatus as claimed in claim 15, wherein a pair of clips comprises a first clip and a second clip, said first clip defined on said third side of said body and extends axially in a direction toward said second side of said body, and said second clip defined on said fourth side of said body and extends axially in a direction toward said second side of said body.

18. The apparatus as claimed in claim 15, wherein said pair of tabs comprises a first tab and a second tab, said first tab defined on said third side of said body and extends axially in a direction toward said second side of said body, and said second tab defined on said fourth side of said body and extends axially in a direction toward said second side of said body.

19. A modular connector strain relief back shell apparatus comprising:

a housing having a first open side and a second open side;

a plurality of wire-tie receiving orifices defined adjacent said second open side of said housing;

a modular frame having a plurality of receiving sections; said frame capable of being received within said housing;

at least one modular connector having a body;

a plurality of wire-receiving cavities defined in said body for receiving wire; and wherein said body of said modular connector is insertable within said receiving section of said modular frame.

20. A method of providing wire strain relief when using pre-wired modules for electrical wiring application, said method comprising the steps of:

(a) providing a modular connector strain relief back shell apparatus comprising a housing having a first open side and a second open side, a plurality of wire-tie receiving orifices defined adjacent said second side open of said housing, a modular frame having a plurality of receiving sections, said modular frame capable of being received within said housing, and, at least one modular connector having a plurality of wire-receiving cavities, wherein said modular connector capable of being received within said receiving section of said modular frame;

(b) inserting a plurality of wires through said wire-receiving cavities of said modular connector;

(c) inserting said modular connector into said modular frame;

(d) inserting said modular frame into said housing; and (e) fastening at least one wire within said wire-receiving cavity to said housing via a wire-tie inserted through at least two wire-tie receiving orifices and fastened around said wire.

* * * * *